US009273379B2

(12) United States Patent
Konno et al.

(10) Patent No.: US 9,273,379 B2
(45) Date of Patent: Mar. 1, 2016

(54) TITANIUM ALLOY PRODUCT HAVING HIGH STRENGTH AND EXCELLENT COLD ROLLING PROPERTY

(71) Applicant: Kobe Steel, Ltd., Kobe (JP)

(72) Inventors: Takashi Konno, Takasago (JP); Keita Sasaki, Takasago (JP); Yoshio Itsumi, Takasago (JP); Hideto Oyama, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 105 days.

(21) Appl. No.: 13/869,465

(22) Filed: Apr. 24, 2013

(65) Prior Publication Data

US 2013/0336835 A1 Dec. 19, 2013

(30) Foreign Application Priority Data

Jun. 18, 2012 (JP) ..... 2012-136704

(51) Int. Cl.
*C22C 14/00* (2006.01)
*C22F 1/18* (2006.01)

(52) U.S. Cl.
CPC . *C22C 14/00* (2013.01); *C22F 1/18* (2013.01); *C22F 1/183* (2013.01)

(58) Field of Classification Search
CPC ..... C22C 14/00
USPC ..... 148/421; 420/418, 419
See application file for complete search history.

(56) References Cited

U.S. PATENT DOCUMENTS

| | | | | |
|---|---|---|---|---|
| 6,228,189 | B1 | 5/2001 | Oyama et al. | |
| RE38,316 | E | 11/2003 | Oyama et al. | |
| 2001/0041148 | A1 | 11/2001 | Oyama et al. | |
| 2003/0089433 | A1 | 5/2003 | Oyama et al. | |
| 2004/0231756 | A1* | 11/2004 | Bania | 148/421 |
| 2009/0180918 | A1* | 7/2009 | Tsai et al. | 420/419 |
| 2011/0268602 | A1* | 11/2011 | Wright et al. | 420/419 |

FOREIGN PATENT DOCUMENTS

| | | | |
|---|---|---|---|
| CN | 101514412 | A | 8/2009 |
| CN | 101550505 | | 10/2009 |
| EP | 1 736 560 | A1 | 12/2006 |
| JP | 1-111835 | | 4/1989 |
| JP | 2-57136 | | 12/1990 |
| JP | 7-39616 | B2 | 5/1995 |
| JP | 2000-204425 | | 7/2000 |
| JP | 2000-204425 | A | 7/2000 |
| WO | WO 2012/021186 | A2 | 2/2012 |
| WO | WO 2012/021186 | A3 | 2/2012 |

OTHER PUBLICATIONS

Sanders. "Aluminum and Aluminum Alloys." Kirk-Othmer Encyclopedia of Chemical Technology. pp. 279-343. Posted online Nov. 15, 2002.*

Extended European Search Report issued Nov. 8, 2013 in Patent Application No. 13002246.0.

Zhang Xi-Yan, et al., "Titanium Alloys and their Applications", Chemical Industry Press, Apr. 2005 (w/English Translation).

* cited by examiner

*Primary Examiner* — Brian Walck
(74) *Attorney, Agent, or Firm* — Oblon, McClelland, Maier & Neustadt, L.L.P.

(57) ABSTRACT

A titanium alloy product according to the present invention: has a strength level higher than that of an existing titanium alloy product; can be successfully cold rolled (coil rolled); and is also provided with workability. In the titanium alloy product according to the invention, expensive alloy elements are not essentially required, and hence cost can be suppressed. The titanium alloy product according to the invention includes Al equivalent represented by (Al+10O (oxygen)): 3.5 to 7.2% (% by mass, the same hereinafter), Al: more than 1.0% and 4.5% or less, O: 0.60% or less, Fe equivalent represented by (Fe+0.5Cr+0.5Ni+0.67Co+0.67Mn): 0.8% or more and less than 2.0%, and one or more elements selected from the group consisting of Cu: 0.4 to 3.0% and Sn: 0.4 to 10%, in which the balance is Ti and unavoidable impurities.

17 Claims, No Drawings

TITANIUM ALLOY PRODUCT HAVING HIGH STRENGTH AND EXCELLENT COLD ROLLING PROPERTY

BACKGROUND OF THE INVENTION

1. Field of the Invention

The present invention relates to a titanium alloy product having a high strength and an excellent cold rolling property.

2. Description of the Related Art

Because titanium alloys have high specific strength and are excellent in corrosion resistance, they are used in a wide range of fields as members of aerospace instrument, members of chemical plant, and automotive members. An example of a typical titanium alloy includes Ti-6Al-4V alloy. This Ti-6Al-4V alloy is excellent in strength properties, as the 0.2% proof stress of 828 MPa or more is standardized in ASTM Gr. 5;however, is poor in a cold rolling property because a large amount of Al is comprised as an additive element. Accordingly, it is difficult to manufacture a thin plate of the alloy by coil rolling, and is processed into a thin plate by a process generally called pack rolling. In this pack rolling, titanium plates obtained by hot rolling are piled up in layers to be wrapped up with a mild steel cover, and then hot rolled while the temperature thereof is being kept not to be lower than a predetermined one, thereby allowing titanium plates to be manufactured. In this process, there are problems that the work is extremely complicated in comparison with cold rolling and the process needs a lot of expenses. Further, there are many restrictions in terms of processing, because the temperature range suitable for the hot rolling is limited.

On the other hand, an example of a general-purpose titanium alloy that can be coil rolled includes, for example, Ti-3Al-2.5V alloy (ASTM Gr. 9). However, the 0.2% proof stress of this alloy is approximately 500 MPa, which is considerably smaller than that of the aforementioned Ti-6Al-4V alloy. In addition, Japanese Patent Publication No. Hei 2(1990)-57136 discloses a heat-resistant Ti alloy plate excellent in cold workability. This alloy plate has been developed for the first purpose of improving cold workability, and the additive content of each of an α-stabilizing element and a β-stabilizing element is low. Accordingly, an increase in strength by solute strengthening is small, and hence it is difficult to use this alloy plate in an application in which a high strength is required.

On the other hand, as a titanium alloy that has a strength similar to that of the Ti-6Al-4V alloy and that can be coil rolled, KSTi-9 (Ti-4.5Al-2Mo-1.6V-0.5Fe-0.3Si-0.05C, ASTM Gr. 35, Japanese Patent No. 3297027) has been developed, and cold rolled coils thereof are actually manufactured on a mass-production scale. Similarly to the Ti-6Al-4V alloy, Mo and V are used as β-stabilizing elements in the KSTi-9. In addition, an example of a high strength Ti alloy includes Ti-4Al-2.5V-1.5Fe-0.250 (ATI 425 (U.S. registered trademark)). In this Ti alloy, V is used as a major β-stabilizing element (β-strengthening element).

Further, Japanese Unexamined Patent Publication No. Hei 1(1989)-111835 discloses an alloy that has been developed for the purpose of improving cold workability. In the Ti alloy disclosed therein, the additive content of a β-stabilizing element is high to obtain high workability thanks to a residual β-phase.

SUMMARY OF THE INVENTION

As stated above, a titanium alloy to be used for members of aerospace instrument is required to have a high strength and an excellent cold rolling property (coil rolling can be performed). If a cold rolling property is remarkably poor, a crack may be generated from an edge of a titanium alloy strip during cold rolling, which may develop and lead to breakage of the strip. If a cold rolling property is remarkably poor even when cold rolling (coil rolling) can be performed, cold rolling-annealing needs to be repeated multiple times, which leads to an increase in cost. In addition, if the workability of a titanium alloy product is poor, it is sometimes difficult to perform work (e.g., bending work, etc.) at an existing product level, even when cold rolling can be performed.

The titanium alloys disclosed in the aforementioned Japanese Patent No. 3297027 and Japanese Unexamined Patent Publication No. Hei 1(1989)-111835 and the aforementioned Ti-4Al-2.5V-1.5Fe-0.250 alloy have high strengths and cold rolling properties, as stated above; in each of them, however, alloy elements (Mo, V, Nb, etc.), which are rare metals and expensive, are essentially comprised as β-strengthening elements, thereby causing costs to be increased.

The present invention has been made in view of such situations, and an object of the invention is to achieve, without expensive alloy elements (Mo, V, Nb, etc.) being essentially comprised, a titanium alloy: which has a strength level higher than that of an existing titanium alloy product; which can be successfully coil rolled (cold rolled); and which is provided with workability (elongation, ductility) at an existing product level.

A titanium alloy product according to the present invention, by which the aforementioned problems can be solved, comprises Al equivalent represented by (Al+10O (oxygen)): 3.5 to 7.2% (% by mass, the same hereinafter), Al: more than 1.0% and 4.5% or less, O: 0.60% or less, Fe equivalent represented by (Fe+0.5Cr+0.5Ni+0.67Co+0.67Mn): 0.8% or more and less than 2.0%, and one or more elements selected from the group consisting of Cu: 0.4 to 3.0% and Sn: 0.4 to 10%, in which the balance is Ti and unavoidable impurities.

The aforementioned titanium alloy product may further comprise one or more selected from the group consisting of Si and C, so that the following inequation (1) is satisfied:

$$Si+5C<1.0 \quad (1)$$

[wherein, Si and C represent the contents (% by mass) of the respective elements in the titanium alloy product.]

According to the present invention, a titanium alloy: which has a strength higher than that of the Ti-3Al-2.5V alloy, which is an existing alloy that can be coil rolled; which is provided with a high cold rolling property in which coil rolling can be performed successfully; and which is further provided with workability (elongation of a certain value or more) can be achieved, without expensive alloy elements, such as the aforementioned V, being essentially comprised. Because the titanium alloy according to the invention can attain a strength level equivalent to that of the Ti-6Al-4V alloy, it can be used for manufacturing members of aerospace instrument, members for chemical plant, and automotive members, etc., thereby allowing such members having high strengths to be provided at high productivity and inexpensive costs.

The strength level attained by the titanium alloy product according to the present invention is higher than that of the Ti-3Al-2.5V alloy, which can be coil rolled, and equivalent to that of the Ti-6Al-4V alloy.

The Ti-6Al-4V alloy and Ti-3Al-2.5V alloy are standardized as ASTM Grade 5 and Grade 9, respectively, and the 0.2% proof stress (YS) thereof are 828 MPa or more and 483 MPa or more, respectively. In consideration of these, a target strength is set to be "700 MPa or more in terms of 0.2% proof stress (YS)", which can be considered to be practically and sufficiently higher than that of the Ti-3Al-2.5V alloy.

DETAILED DESCRIPTION OF THE INVENTION

In order to solve the aforementioned problems, the present inventors have intensively studied in order to obtain a titanium alloy product: which is an (α+β)-type titanium alloy; and which is provided with all of a high strength, a cold rolling property, and workability (elongation equivalent to or more than that of the Ti-6Al-4V alloy), without the aforementioned expensive alloy elements being essentially comprised as an α-stabilizing element and a β-eutectoid stabilizing element.

As a result, the inventors have found that the means shown in the following (1) to (3) are particularly effective, and have made the present invention.

(1) The range of Al equivalent: Al+10O (oxygen) represented by Al and O, which are α-stabilizing elements, has been specified. Of the two, Al is made to be essential for effectively acting for improvement of a strength, on the other hand, however, it is also an element incurring a decrease in a cold rolling property or elongation, and hence the content thereof (independent content of Al) has been made to be smaller than that of a general-purpose alloy, such as the Ti-6Al-4V alloy.

(2) Fe, Cr, etc., which are β-eutectoid stabilizing elements whose costs are relatively cheap, have been made to be used as β-stabilizing elements instead of Mo and V that are expensive ones, and an optimal range of Fe equivalent (Fe+0.5Cr+0.5Ni+0.67Co+0.67Mn) has been found as an alloy composition formed by these inexpensive elements.

(3) Further, it has been found that Cu and Sn, which are solid-soluble in both an α-phase and β-phase, are effective for improving a balance between strength-elongation, and hence at least one of the two elements has been made to be used.

Hereinafter, the reasons why the component ranges of the aforementioned elements have been specified in the present invention will be described in detail.

[Al Equivalent Represented by (Al+10O (Oxygen)): 3.5 To 7.2%]

Al and O are α-stabilizing elements and strengthen an α-phase. In the present invention, a balance among a strength, cold rolling property, and elongation has been achieved by specifying the range of the Al equivalent represented by Al+10×O (oxygen).

In detail, if the aforementioned (Al+10O) is less than 3.5%, a strength is insufficient and 0.2% proof stress of 700 MPa or more cannot be obtained. Accordingly, the minimum of the Al equivalent is 3.5%. The Al equivalent is preferably 4.0% or more, and more preferably 4.3% or more.

On the other hand, if the Al equivalent is too large, at least one of an elongation and a cold rolling property is decreased. Accordingly, the Al equivalent has been made to be 7.2% or less. The Al equivalent is preferably 7.0% or less, and more preferably 6.5% or less.

[Al: More Than 1.0% and 4.5% Or Less]

Al is an element by which an α-phase can be strengthened with a relatively small decrease in elongation, in comparison with the case where O is independently added. Further, Al is also an element having an effect of suppressing, in the transformation from a β-phase, the precipitation of an co-phase by which embrittlement is prompted. Because it is effective in the present invention to add Al and O in combination, Al has been made to be essential and made the independent amount thereof to be more than 1.0%. The amount thereof is preferably 1.5% or more, and more preferably 2.0% or more.

On the other hand, addition of Al in an excessive amount particularly impairs a cold rolling property. Accordingly, the maximum of the amount of Al is 4.5% in the invention. The amount of Al is preferably 4.0% or less, and more preferably 3.5% or less.

[O: 0.60% or less]

O is an element exhibiting a great solute strengthening ability, but if the amount of O is too large even when the Al equivalent is within the aforementioned range, the toughness is decreased, and hence a plate is likely to break during cold rolling and a stable cold rolling property cannot be obtained. Accordingly, the amount of O has been made to be 0.60% or less. The amount thereof is preferably 0.55% or less, more preferably 0.50% or less, and still more preferably 0.40% or less.

In a general titanium alloy, the amount of O is controlled to be 0.2% or less, but in the composition according to the present invention, O can be comprised in an amount up to 0.60%, as stated above, and ductility is never impaired even when O is comprised in an amount larger than that in a conventional and general titanium alloy. This indicates that cheap off-grade sponge titanium or titanium scrap, comprising a lot of impurities, such as O and Fe, can be used as a raw material for the titanium alloy product of the invention, thereby allowing the cost to be further reduced.

[Fe Equivalent Represented by (Fe+0.5Cr+0.5Ni+0.67Co+0.67Mn): 0.8% Or More and Less Than 2.0%]

A β-eutectoid stabilizing element, such as Fe, Cr, Ni, Co, Mn, or the like, has effects of: increasing a strength by being added in a small amount; and improving hot workability. In the present invention, a strength is intended to be improved by controlling the Fe equivalent obtained by arranging these elements.

If this Fe equivalent is too small, a desired strength level cannot be attained. Accordingly, the Fe equivalent has been made to be 0.8% or more in the present invention. The Fe equivalent is preferably 1.0% or more, and more preferably 1.2% or more.

On the other hand, if the Fe equivalent is too large, segregation, occurring while an ingot is being manufactured, becomes remarkable, thereby possibly causing quality stability to be impaired. In addition, an intermetallic compound, which is an equilibrium phase, is likely to be generated, and hence a decrease in the cold rolling property and embrittlement may be generated. Accordingly, the Fe equivalent has been made to be less than 2.0% in the present invention. The Fe equivalent is preferably 1.8% or less, more preferably 1.6% or less, still more preferably 1.5% or less, and particularly preferably 1.4% or less.

In the present invention, the additive content of a β-stabilizing element is controlled to be low from the viewpoints of suppressing ingot segregation and a decrease in ductility, occurring due to precipitation of an intermetallic compound, as stated above, unlike in the aforementioned Japanese Patent No. 3297027.

The aforementioned equation for Al equivalent is obtained by using Eq. 2.1 in "Materials Properties Handbook: Titanium Alloys", by Rodney Boyer, Gerhard Welsch, and E. W. Collings, ASM International, 1994, p. 10. That is, both the a term of Zr, which is not comprised in the present invention, and a term of Sn, which is determined to be an element that is solid-soluble in both an α-phase and β-phase in the invention, as stated above, are deleted in Eq 2.1.

The equation for Fe equivalent is obtained by converting the equation for Mo equivalent (Eq. 2.2) shown in the aforementioned Handbook. That is, in Eq. 2.2, terms of the elements, which are not comprised in the present invention, are deleted, and the coefficient of the term of each element amount is divided by 2.5 such that the coefficient of the term of Fe amount in the right-hand side becomes 1.

In the aforementioned equations for Al equivalent and Fe equivalent, calculation is made by making the term of an element that is not comprised to be 0.

In the present invention, the content of each of Fe, Cr, Ni, Co, and Mn, which form the aforementioned Fe equivalent, is not particularly limited. In addition, it is not required that the aforementioned elements of Fe, Cr, Ni, Co, and Mn are all comprised, but it is only required that one or more elements selected from the group consisting of the above 5 elements are comprised and that the aforementioned Fe equivalent is within the specified range. In p. 7 to 9 of the aforementioned document: "Materials Properties Handbook: Titanium Alloys", sorting of alloy elements is shown, in which it is shown that Fe, Cr, Ni, Co, and Mn are sorted into β-eutectoid stabilizing elements. In addition, the fact that these 5 elements similarly exert the aforementioned effects is also described particularly in Paragraphs 0012 and 0013 of Japanese Patent Publication No. 3297027.

[One or More Elements Selected from Group Consisting of Cu: 0.4 to 3.0% and Sn: 0.4 to 10%]

Although Cu is a β-eutectoid stabilizing element, similarly to Fe, Cu exerts an effect of increasing a strength without greatly impairing a cold rolling property and elongation by being-soluble in an α-phase in an amount larger than those of other β-stabilizing elements. Sn is a neutral element to be solid-soluble in both an α-phase and β-phase and also contributes to strengthening. In addition, similarly to Cu, a degree of a decrease in an elongation, occurring when it is added, is small (as clear from the comparison between No. 9 and No. 10 in the later-described Examples). It is assumed that, because each of Cu and Sn is solid-soluble in an α-phase in a relatively large amount, a strength can be increased without impairing ductility, as stated above. Further, Sn has also an effect of suppressing the precipitation of an co-phase that is an embrittling phase.

The amount of each element for sufficiently exerting the aforementioned effects has been studied. As a result, when Cu is to be comprised, the amount of it, by which YS of 700 MPa or more can be attained, has been determined to be 0.4% or more from the calculation based on both the data of the later-described Example No. 5 (YS is 671 MPa without Cu) and the data of Example No. 6 (YS is 706 MPa when Cu is comprised in an amount of 0.5%). Accordingly, when Cu is to be comprised, the amount thereof is made to be 0.4% or more (preferably 0.5% or more, and more preferably 1.0% or more).

When Sn is to be comprised, the amount of it, by which YS of 700 MPa or more can be attained, has been determined to be 0.4% or more from the calculation based on both the data of the later-described Example No. 4 (YS is 651 MPa without Sn) and the data of Example No. 9 (YS is 705 MPa when Cu is comprised in an amount of 0.5%). Accordingly, when Sn is to be comprised, the amount thereof is made to be 0.4% or more (preferably 0.5% or more, and more preferably 1.0% or more).

In the present invention, at least one of Cu and Sn may be comprised.

On the other hand, if Cu is comprised in an excessive amount, a lot of Ti2Cu precipitate, thereby causing a decrease in an elongation or cold rolling property. In the present invention, the maximum of the amount of Cu, which is at a level in which this Ti2Cu never precipitates excessively, is 3.0%. The amount thereof is preferably 2.5% or less, and more preferably 2.0% or less. In addition, if the amount of Sn is more than 1.0%, a decrease in elongation, an increase in specific gravity, and an increase in cost may be caused. Accordingly, the amount of Sn has been made to be 10% or less in the invention. The amount thereof is preferably 7% or less, more preferably 4% or less, still more preferably 2.5% or less, and particularly preferably 2.0% or less.

The basic component composition of the titanium alloy product according to the present invention is as stated above, and the balance is Ti and unavoidable impurities.

In addition, properties may be further improved by comprising Si and C, so that the following inequation is satisfied:

$$[Si+5C<1.0]$$

An adverse influence by each of Si and C on the cold rolling property of an (α+β)-type titanium alloy is small and each of them has an effect of increasing a strength property. Si forms a compound and contributes to making a microstructure to be fine, thereby having an effect of securing an excellent balance between strength-elongation. Further, Si is also an element effective for improving oxidation resistance and weldability.

Si is different from Sn in that Si forms a precipitate and suppresses precipitation strengthening or coarsening of grain size, thereby contributing to an improvement of the balance between strength-elongation, while the aforementioned Sn contributes to an improvement of a strength by being solid-soluble in both an α-phase and β-phase.

C is an element contributing to solute strengthening, and also an element exerting an effect similar to that of Si by forming a precipitate similarly to Si.

In order to exert the aforementioned effects, when Si is to be comprised, the independent amount thereof is preferably 0.05% or more, and more preferably 0.10% or more. When C is to be comprised, the independent amount of C is preferably 0.03% or more, and more preferably 0.05% or more.

Either of Si and C may be used, or both of the two may be used. However, if (Si+5C) is 1.0% or more, an amount of precipitates becomes too large, and hence an elongation and cold rolling property are decreased. Accordingly, it is preferable to make (Si+5C) to be less than 1.0%. (Si+5C) is preferably 0.8% or less, and more preferably 0.6% or less.

EXAMPLES

Hereinafter, the present invention will be described in more detail with reference to Examples, but the invention should not be limited by the following Examples, and the invention can also be practiced by adding modifications within a range in which each of the modifications suits the intents before and after thereof, which can be encompassed by the scope of the invention.

Each of the titanium alloys having component compositions shown in Table 1 (in Table 1, a blank means that an element is not added) was ingoted by an arc melting process to obtain a button ingot having a size of 40 mm in diameter× 20 mm in height. After the button ingot was hot forged by heating to 1000° C., it was heated again to 1000° C. and hot rolled to have a plate thickness of 3.5 mm. Subsequently, annealing (800° C.×5 minutes) was performed on the obtained hot rolled plate, and then the plate was shot blasted and pickled to obtain a hot rolled annealed plate having a thickness of 3.0 mm. Thereafter, the plate was cold rolled until the plate had a thickness of 1.8 mm (a plate having a relatively low cold rolling property, in which the length of a crack reached 3 mm until the plate had a thickness of 1.8 mm, was cold rolled until the plate had a thickness of 2.1 mm), and annealing (800° C.×5 minutes) was performed thereon. After a plate of each Example was pickled (dissolved with an acid)

until the plate had a thickness of 1.7 mm, and was again cold rolled to obtain a cold rolled plate having a thickness of 1.1 mm (a plate having a relatively low cold rolling property, in which the length of a crack reached 3 mm until the plate had a thickness of 1.1 mm, was cold rolled until the plate had a thickness of 1.2 mm).

After final annealing (800° C.×5 minutes) was performed on the cold rolled plate, descaling (acid pickling) was performed to obtain a titanium alloy plate having a thickness of 1.0 mm in each Example. Each of the aforementioned annealing was performed in the air, and after the annealing, the plate was cooled in the air.

The strength property and cold rolling property of a titanium alloy plate thus obtained were evaluated by performing tensile tests as follows.

which a crack having a length of more than 3 mm is generated from an end of the cold rolled plate during the aforementioned cold rolling step. In detail, when the aforementioned hot rolled and annealed plate having a thickness of 3.0 mm was cold rolled until the thickness became 2.1 mm, the case where a crack having a length of more than 3 mm was not generated even after the cold rolling at which the cold rolling ratio was 30% or more was performed was evaluated as being excellent in a cold rolling property (○); and the case where a crack having a length of more than 3 mm was generated until the cold rolling ratio reached 30% was evaluated as being inferior in a cold rolling property (×).

These results are collectively shown in Table 1.

TABLE 1

| | Component Composition (% by mass) | | | | | | | | | Al Equivalent | Fe Equivalent | Si + 5C | YS | EL | Cold Rolling |
|---|---|---|---|---|---|---|---|---|---|---|---|---|---|---|---|
| No. | Ti | Al | Fe | Cr | Cu | Sn | Si | C | O | (% by mass) | (% by mass) | (% by mass) | (MPa) | (%) | Property |
| 1 | Bal. | 3.0 | | | | | | | 0.15 | 4.50 | 0.00 | 0 | 449 | 23.0 | ○ |
| 2 | Bal. | 3.0 | 1.0 | | | | | | 0.15 | 4.50 | 1.00 | 0 | 584 | 16.2 | ○ |
| 3 | Bal. | 3.0 | 2.0 | | | | | | 0.15 | 4.50 | 2.00 | 0 | 627 | 18.2 | ○ |
| 4 | Bal. | 3.0 | 1.0 | 0.5 | | | | | 0.15 | 4.50 | 1.25 | 0 | 651 | 21.6 | ○ |
| 5 | Bal. | 3.0 | 1.0 | 1.0 | | | | | 0.15 | 4.50 | 1.50 | 0 | 671 | 20.8 | ○ |
| 6 | Bal. | 3.0 | 1.0 | 1.0 | 0.5 | | | | 0.15 | 4.50 | 1.50 | 0 | 706 | 20.3 | ○ |
| 7 | Bal. | 3.0 | 1.0 | 0.5 | 1.0 | | | | 0.15 | 4.50 | 1.25 | 0 | 718 | 20.0 | ○ |
| 8 | Bal. | 3.0 | 1.0 | 1.5 | 1.0 | | | | 0.15 | 4.50 | 1.75 | 0 | 767 | 20.6 | ○ |
| 9 | Bal. | 3.0 | 1.0 | 0.5 | | 0.5 | | | 0.15 | 4.50 | 1.25 | 0 | 705 | 21.4 | ○ |
| 10 | Bal. | 3.0 | 1.0 | 0.5 | | 2.0 | | | 0.15 | 4.50 | 1.25 | 0 | 712 | 21.0 | ○ |
| 11 | Bal. | 3.0 | 1.0 | 0.5 | 1.0 | 2.0 | | | 0.15 | 4.50 | 1.25 | 0 | 756 | 18.4 | ○ |
| 12 | Bal. | 1.5 | 1.0 | 0.5 | 1.0 | 1.0 | | | 0.15 | 3.00 | 1.25 | 0 | 627 | 22.5 | ○ |
| 13 | Bal. | 2.0 | 1.0 | 0.5 | 1.0 | 2.0 | | | 0.20 | 4.00 | 1.25 | 0 | 719 | 22.5 | ○ |
| 14 | Bal. | 1.5 | 1.0 | 0.5 | 1.0 | 1.0 | | | 0.40 | 5.50 | 1.25 | 0 | 812 | 14.4 | ○ |
| 15 | Bal. | 2.0 | 1.0 | 0.5 | 1.0 | 1.0 | | | 0.40 | 6.00 | 1.25 | 0 | 849 | 13.0 | ○ |
| 16 | Bal. | 2.0 | 1.0 | 0.5 | 1.0 | 1.0 | | | 0.50 | 7.00 | 1.25 | 0 | 923 | 10.3 | ○ |
| 17 | Bal. | 2.0 | 1.0 | 0.5 | 1.0 | 1.0 | | | 0.55 | 7.50 | 1.25 | 0 | 960 | 8.9 | ○ |
| 18 | Bal. | 0.0 | 1.0 | 0.5 | 1.0 | 2.0 | | | 0.70 | 7.00 | 1.25 | 0 | — | — | x |
| 19 | Bal. | 1.5 | 1.0 | 0.5 | 1.0 | 2.0 | | | 0.55 | 7.00 | 1.25 | 0 | 913 | 10.7 | ○ |
| 20 | Bal. | 4.0 | 1.0 | 0.5 | 1.0 | 2.0 | | | 0.15 | 5.50 | 1.25 | 0 | 830 | 15.7 | ○ |
| 21 | Bal. | 5.0 | 1.0 | 0.5 | 1.0 | 2.0 | | | 0.15 | 6.50 | 1.25 | 0 | 904 | 12.9 | x |
| 22 | Bal. | 3.0 | 0.5 | | 1.0 | 2.0 | | | 0.15 | 4.50 | 0.50 | 0 | 684 | 23.5 | ○ |
| 23 | Bal. | 3.0 | 1.0 | 0.5 | 2.0 | 2.0 | | | 0.15 | 4.50 | 1.25 | 0 | 827 | 13.6 | ○ |
| 24 | Bal. | 3.0 | 1.0 | 0.5 | 3.0 | 2.0 | | | 0.15 | 4.50 | 1.25 | 0 | 843 | 11.3 | ○ |
| 25 | Bal. | 3.0 | 1.0 | 0.5 | 3.5 | 2.0 | | | 0.15 | 4.50 | 1.25 | 0 | — | — | x |
| 26 | Bal. | 3.0 | 1.0 | 0.5 | 1.0 | | | 0.05 | 0.15 | 4.50 | 1.25 | 0.25 | 721 | 18.8 | ○ |
| 27 | Bal. | 3.0 | 1.0 | 0.5 | 1.0 | | | 0.2 | 0.15 | 4.50 | 1.25 | 1.0 | 803 | 3.5 | x |
| 28 | Bal. | 3.0 | 1.0 | 0.5 | 1.0 | | 0.1 | 0.05 | 0.15 | 4.50 | 1.25 | 0.35 | 775 | 16.0 | ○ |
| 29 | Bal. | 3.0 | 1.0 | 0.5 | 1.0 | | 0.3 | | 0.15 | 4.50 | 1.25 | 0.3 | 785 | 14.0 | ○ |
| 30 | Bal. | 3.0 | 1.0 | 0.5 | 1.0 | | 0.6 | | 0.15 | 4.50 | 1.25 | 0.6 | 832 | 11.4 | ○ |
| 31 | Bal. | 3.0 | 1.0 | 0.5 | 1.0 | | 1.0 | | 0.15 | 4.50 | 1.25 | 1.0 | 890 | 5.0 | x |

[Tensile Test (Measurement of 0.2% Proof Stress and Elongation)]

A tensile specimen having the ASTM E8 sub-size (6 mm in width×32 mm in length of a parallel portion) was taken out from the obtained titanium alloy plate such that the tensile load axis became parallel to the rolling direction, and the room-temperature tensile property thereof was evaluated by 0.2% proof stress (YS) and elongation (EL). In the present invention, the case where the 0.2% proof stress was 700 MPa or more was evaluated as a high strength, and the case where the elongation was 10% or more was evaluated as having the workability at an existing product level (as exhibiting a predetermined elongation).

[Evaluation of Cold Rolling Property]

If the length of a crack generated by cold rolling becomes more than 3 mm, the crack rapidly develops. Accordingly, a cold rolling property was evaluated by a cold rolling ratio at From Table 1, considerations can be made as follows:

No. 1 is a Ti-3Al alloy product (Comparative Example), which is assumed to be a base in the present Example. Although this No. 1 is excellent in ductility because the elongation is 23.0%, the 0.2% proof stress is 449 MPa and the strength is small.

Each of Nos. 2 to 5 is an alloy in which β-eutectoid stabilizing elements (Fe, Cr) have been added, in amounts within the specified ranges, to No. 1 that is a base. Although the strength is increased by adding the aforementioned β-eutectoid stabilizing elements, the 0.2% proof stress of each of them is less than 700 MPa. That is, in each of these Examples, the strength is higher than that of the existing Ti-3Al-2.5V alloy, but does not reach the strength level of the present invention (700 MPa or more).

Subsequently, an effect, occurring when Cu or Sn was added, was studied. At first, each of Nos. 6 to 8 represents an example in which an influence by addition of Cu on strength was studied by adding Cu to the titanium alloy product of each of the aforementioned No. 4 and No. 5, in each of which the strength was insufficient. In detail, No. 6 represents an example in which Cu was added, in an amount of 0.5%, to No. 5 whose strength was insufficient. In No. 6, 0.2% proof stress of more than 700 MPa was obtained. Each of Nos. 7 and 8 represents an example according to the present invention, in which Cu is comprised in an amount of 1.0%. In each of Nos. 7 and 8, high 0.2% proof stress of 700 MPa or more, a large elongation of approximately 20%, and further a good cold rolling property have been obtained.

No. 9 represents an example in which Sn was further added, in an amount of 0.5%, to No. 4, in which a high strength and elongation at a desired level, and further an excellent cold rolling property have been simultaneously achieved.

No. 10 represents an example in which Sn was comprised in an amount of 2.0%, which was higher than that in No. 9. When No. 10 and No. 9 are compared with each other, the elongation in No. 10 is not impaired, in spite that the strength is higher than that of No. 9. From this fact, it is known that, as stated above, Sn is an additive element effective for improving a balance between strength-elongation.

On the other hand, it is known that, as shown in No. 11, the effects by both elements of Cu and Sn can also be efficiently exerted when both the elements are comprised in the specified ranges.

Each of Nos. 12 to 21 represents a result obtained when an influence by Al equivalent on a tensile property was studied by changing the Al equivalent (addition amounts of Al and 0). In No. 12, the Al equivalent is 3.00%, which is less than the specified range of the present invention, and hence the 0.2% proof stress is much less than 700 MPa. On the other hand, in No. 13, the Al equivalent is 4.00%, and the 0.2% proof stress of 700 MPa or more has been attained.

As the Al equivalent is increased, the 0.2% proof stress is increased, but an elongation is likely to be decreased. In each of No. 13 to No. 16, the Al equivalent is 4.00 to 7.00%, and a predetermined elongation and an excellent cold rolling property have been exerted, while, in No. 17, the Al equivalent is as large as 7.50%, and the elongation is less than 10%.

On the other hand, No. 18 represents an example in which the Al equivalent is within the specified range, while the amount of O is too large and Al is not comprised. In this No. 18, the plate was broken during cold rolling, and hence a sample was not able to be produced. As a reason for that, it can be considered that the toughness may have been decreased particularly due to the excessive amount of O.

No. 19 represents an example in which, although the Al equivalent is the same as that of No. 18, Al is added in an amount of 1.5% to and O is reduced in an amount of 1.5% from the component composition of No. 18. From the comparison between No. 18 and No. 19, it is known that a high strength, a predetermined elongation, and an excellent cold rolling property can be secured with the balance between Al and O being made to be the same as in No. 19, even when the Al equivalent is the same.

No. 21 represents an example in which Al equivalent is within the specified range and an amount of Al is made to be 5.0%. When the amount of Al is 5.0%, a cold rolling ratio of 30% or more cannot be obtained and a cold rolling property becomes poor. On the other hand, No. 20 represents an example in which Al equivalent is made to be within the specified range and an amount of Al is made to be 4.0%. It is known that a cold rolling property is also good when the amount of Al is 4.0%.

No. 22 represents an example in which Fe equivalent is as small as 0.50%. When the Fe equivalent is too small, i.e., when the addition amount of a β-eutectoid stabilizing element is too small, 0.2% proof stress becomes small, and hence a desired strength cannot be obtained.

Each of Nos. 23 to 25 represents an result obtained when an influence by an amount of Cu has been studied. From the comparison among these examples, it is known that, by an increase in the amount of Cu, a strength is increased, but an elongation and a cold rolling property are decreased. When the amount of Cu is 3.5%, as in No. 25, it becomes difficult to perform cold rolling. This is because, when Cu is added in a large amount, a large amount of precipitates ($Ti_2Cu$) are formed and an elongation and a cold rolling property are decreased.

No. 26 represents an example in which a predetermined amount of C is further comprised, and a high strength, an excellent cold rolling property, and a predetermined elongation have been attained. On the other hand, in No. 27, the amount of C is too large, and hence a large amount of precipitates have been dispersed and the elongation and cold rolling property have become insufficient.

No. 28 represents an example in which both Si and C have been added in combination, and each of Nos. 29 and 30 represents an example in which, of the two elements, Si is only comprised and the amount thereof is larger than that of No. 28. In each of Nos. 28 to 30, a high strength, an excellent cold rolling property, and a predetermined elongation have been attained. On the other hand, in No. 31, the amount of Si is too large, and hence a large amount of precipitates have been dispersed and the elongation and the cold rolling property have become insufficient.

What is claimed is:

1. A titanium alloy product, comprising:

Al: more than 1.0 mass % and 4.0 mass % or less;

O: 0.60 mass % or less;

one or more elements selected from the group consisting of Fe, Cr, Ni, Co, and Mn;

one or more elements selected from the group consisting of Cu: from 0.4 to 3.0 mass % and Sn: from 0.4 to 10 mass %; and Ti, wherein Al equivalent represented by (Al+10O) is from 3.5 to 7.2 mass %;

Fe equivalent represented by (Fe+0.5Cr+0.5Ni+0.67Co+0.67Mn) is 0.8 mass % or more and less than 2.0 mass %; and the titanium alloy product is an (α+β) titanium alloy material and does not comprise Mo or V.

2. The titanium alloy product according to claim 1, further comprising one or more elements selected from the group consisting of Si and C so that expression (1) is satisfied:

$$Si+5C<1.0 \quad (1)$$

where Si and C represent mass % of Si and C, respectively, in the titanium alloy product.

3. The titanium alloy product according to claim 1, comprising:

O: from 0.20 to 0.50 mass %.

4. The titanium alloy product according to claim 1, wherein the Al equivalent ranges from 4.0 to 7.0 mass %.

5. The titanium alloy product according to claim 1, wherein the Al equivalent ranges from 4.3 to 6.5 mass %.

6. The titanium alloy product according to claim 1, wherein the Fe equivalent ranges from 1.0 to 1.8 mass %.

7. The titanium alloy product according to claim 1, which comprises one or more elements selected from the group consisting of Cu: from 0.4 to 3.0 mass % and Sn: from 0.4 to 2.5 mass %.

8. The titanium alloy product according to claim 2, which comprises one or more elements selected from the group consisting of Si: 0.05 mass % or more and C: 0.03 mass % or more.

9. The titanium alloy product according to claim 1, comprising:

Cu: from 0.4 to 3.0 mass %.

10. A titanium alloy product, consisting essentially of:

Al: more than 1.0 mass % and 4.0 mass % or less;

O: 0.60 mass % or less;

one or more elements selected from the group consisting of Fe, Cr, Ni, Co, and Mn;

one or more elements selected from the group consisting of Cu: from 0.4 to 3.0 mass % and Sn: from 0.4 to 10 mass %;

optionally one or more elements selected from the group consisting of Si and C; and Ti, wherein Al equivalent represented by (Al+10O) is from 3.5 to 7.2 mass %;

Fe equivalent represented by (Fe+0.5Cr+0.5Ni+0.67Co+0.67Mn) is 0.8 mass % or more and less than 2.0 mass %;

when the one or more elements of Si and C are present, an amount of Si and an amount of C represented by Si and C in mass %, respectively, in the titanium alloy product satisfies expression (1):

$$Si+5C<1.0 \quad (1); \text{ and}$$

the titanium alloy product is an ($\alpha+\beta$) titanium alloy material.

11. The titanium alloy product according to claim 10, wherein an amount of O is from 0.20 to 0.50 mass %.

12. The titanium alloy product according to claim 10, wherein the Al equivalent ranges from 4.0 to 7.0 mass %.

13. The titanium alloy product according to claim 10, wherein the Al equivalent ranges from 4.3 to 6.5 mass %.

14. The titanium alloy product according to claim 10, wherein the Fe equivalent ranges from 1.0 to 1.8 mass %.

15. The titanium alloy product according to claim 10, wherein one or more elements selected from the group consisting of Cu: from 0.4 to 3.0mass % and Sn: from 0.4 to 2.5 mass % are present.

16. The titanium alloy product according to claim 10, wherein one or more elements selected from the group consisting of Si: 0.05 mass % or more and C: 0.03 mass % or more are present.

17. The titanium alloy product according to claim 10, comprising:

Cu: from 0.4 to 3.0 mass %.

* * * * *